US009544956B2

(12) United States Patent
Chen et al.

(10) Patent No.: US 9,544,956 B2
(45) Date of Patent: Jan. 10, 2017

(54) TWO-STAGE MULTICHANNEL LED DRIVER WITH CLL RESONANT CIRCUIT

(71) Applicant: Virginia Tech Intellectual Properties, Inc., Blacksburg, VA (US)

(72) Inventors: Xuebing Chen, Blacksburg, VA (US); Daocheng Huang, Blacksburg, VA (US); Qiang Li, Blacksburg, VA (US); Fred C. Lee, Blacksburg, VA (US)

(73) Assignee: Virginia Tech Intellectual Properties, Inc., Blacksburg, VA (US)

( * ) Notice: Subject to any disclaimer, the term of this patent is extended or adjusted under 35 U.S.C. 154(b) by 0 days.

(21) Appl. No.: 14/628,372

(22) Filed: Feb. 23, 2015

(65) Prior Publication Data

US 2015/0289331 A1 Oct. 8, 2015

Related U.S. Application Data

(60) Provisional application No. 61/975,445, filed on Apr. 4, 2014.

(51) Int. Cl.
*H05B 33/08* (2006.01)

(52) U.S. Cl.
CPC ..... *H05B 33/0815* (2013.01); *H05B 33/0851* (2013.01)

(58) Field of Classification Search
CPC ..... H05B 33/0815; H05B 33/0851
USPC ..... 315/186
See application file for complete search history.

(56) References Cited

U.S. PATENT DOCUMENTS 6,888,529 B2 * 5/2005 Bruning ..... G09G 3/3413 345/102
9,000,673 B2 * 4/2015 Feng ..... H05B 33/0839 315/186
9,163,815 B2 * 10/2015 Elferich ..... H02M 1/4258
2011/0260631 A1 * 10/2011 Park ..... H05B 33/0815 315/165
2011/0317452 A1 * 12/2011 Anguelov ..... H02M 3/33584 363/21.02
2012/0299483 A1 * 11/2012 Lethellier ..... H05B 33/0815 315/121
2013/0009560 A1 * 1/2013 Takeda ..... H05B 33/0818 315/201

(Continued)

*Primary Examiner* — Dylan White
(74) *Attorney, Agent, or Firm* — Whitham, Curtis & Cook, P.C.

(57) ABSTRACT

In a two-stage power converter providing voltage regulation in a first stage, zero voltage switching (ZVS) is provided in switches in an unregulated, constant frequency second stage of a two-stage power converter by an inductor of a CLL resonant circuit connected in parallel with both a series connection of an external inductor and a primary winding of one or more transformers connected in series and an output of the switching circuit so that the output capacitances of the switches can be charged and discharged, respectively, by current in the parallel-connected inductor and independently of current in the magnetizing inductance of the transformer. Therefore, the magnetizing inductance of the transformer can be made sufficiently large to balance currents delivered to respective loads as is particularly desirable for driving a plurality of unbalanced LED strings independently of the value of the parallel-connected inductor which is desirably small.

10 Claims, 9 Drawing Sheets

(56) References Cited

U.S. PATENT DOCUMENTS

| | | | | |
|---|---|---|---|---|
| 2013/0127358 | A1* | 5/2013 | Yao | H05B 33/0815 315/201 |
| 2014/0140113 | A1* | 5/2014 | Oh | H02M 1/4241 363/89 |
| 2014/0312789 | A1* | 10/2014 | Feng | H02M 3/33507 315/186 |

* cited by examiner

TWO-STAGE MULTICHANNEL LED DRIVER WITH CLL RESONANT CIRCUIT

CROSS-REFERENCE TO RELATED APPLICATIONS

This application claims benefit of priority of U.S. Provisional Application 61/975,445, filed Apr. 4, 2014, which is hereby incorporated by reference in its entirety.

FIELD OF THE INVENTION

The present invention generally relates to power converters suitable for driving electronic devices and elements and, more particularly, to power converters for driving light-emitting diodes (LEDs) and organic LEDs arranged in a plurality of parallel strings, particularly for illumination applications and which avoid criticality of balance between such strings.

BACKGROUND OF THE INVENTION

Light-emitting (LEDs) diodes have been known for a number of years and have been used in electronic displays of increasing functionality and resolution. Organic light-emitting diodes (OLEDs) have recently been developed and have several properties such as improved color resolution and have become commercially used in high-quality large-screen televisions. Further recent improvements in luminous intensity available from both types of devices, collectively referred to hereinafter simply as LEDs, has also led to the use of such devices for illumination applications, as well. Light-emitting diodes also have longer lifetimes compared with conventional lighting sources such as incandescent, vapor-arc and fluorescent light sources. Moreover, LEDs are ecologically friendly and have good color rendering properties, (e.g. capable of approximating the spectral content of many known light sources including visible sunlight). Therefore, LEDs are a very promising lighting source and can be widely used in many applications, such as indoor lighting, display backlighting, and street lighting. For these applications, strings of multiple series-connected LED structures have been adopted for cost-effectiveness, reliability, and safety concerns.

Forward current of an LED is exponential to its forward voltage when the LED is emitting light. Therefore, a small variation of the forward voltage will result in a dramatic change of the current and consumed power as well as luminous output. For illumination applications having multiple parallel LED strings, the currents of different LED strings are expected to be identical for uniform brightness and thermal performance. Therefore, the current balance among LED strings is highly critical.

Several methods have been proposed to achieve good current balancing and can be generally divided into two categories: active methods and passive methods. For active methods, the power stage usually contains a front-end DC-DC converter as a first stage and a multi-channel constant current source as the second stage. Each channel is controlled by a dedicated switching-mode converter or a linear current regulator to provide constant current. With this method, the forward current of each string can be controlled precisely and there is no current unbalance issue. However, these methods require an impractical number of components and adequately high efficiency cannot be achieved especially when a linear current regulator is used.

For passive methods, good current balance is achieved by passive components such as resistors, capacitors or coupled inductors placed in series with each LED string. This method is very simple. However, the accuracy of current balancing is very sensitive to the impedance of the passive components. In addition, the power dissipation in the series resistor is substantial when used for current balancing; reducing efficiency, often to an unacceptable degree, particularly if dimming is required. Additionally, there are some special requirements to be met by the LED driver when capacitors or coupled inductors are used to achieve balancing of LED strings. For example, the LED driver is required to generate AC current or AC voltage for such reactive components to function properly; increasing component count, cost and complexity and compromising power density and efficiency.

Several single-stage multiple channel LED driver structures have been recently proposed. Specifically, a LED driver based on the voltage-fed half-bridge topology with a current doubler structure at the secondary side has been proposed. This structure is able to drive multiple LED strings at the same time. However, the operation of this LED driver is somewhat complicated especially when larger numbers of LED strings are driven at the same time. In another proposed LED driver, an LLC resonant converter is used with a voltage doubler structure at the secondary side. In this type of LED driver, the switching frequency of converter is regulated when the input voltage varies. Therefore, higher efficiency can not be guaranteed under conditions of wide variation of input voltage.

A one-stage multi-channel constant current ($MC^3$) LLC resonant LED driver has also been proposed in which the switching frequency, $f_s$, is tuned according to the output requirement. However, for this one-stage $MC^3$ LLC resonant LED driver, it is very difficult to achieve low dimming since its efficiency decreases dramatically when it is working under low dimming conditions due to its switching frequency being pushed much higher than the resonant frequency.

SUMMARY OF THE INVENTION

It is therefore an object of the present invention to provide a simple driver circuit having a limited number of circuit components for multiple strings of LEDs which may constitute significantly unbalanced loads while providing substantially balanced currents and equal luminous brightness from all LEDS in all strings and which can provide and maintain high efficiency over a wide range of controllable brightness.

It is another object of the invention to provide an LED driver circuit in which complexity of driver circuitry and operation are substantially unaffected by the number of LED strings driven in a current-balanced manner, regardless of imbalance of loads presented by the LED strings.

In order to accomplish these and other objects of the invention, a power converter including a first stage for regulating output voltage thereof from an input voltage, and a second stage having a switching circuit for connecting and disconnecting the output voltage of the first stage to a primary winding of a transformer, a rectifier circuit to provide an output from a secondary winding of the transformer to a load, and a resonant circuit including a primary winding of the transformer, wherein the resonant circuit includes an inductor connected in parallel with the primary winding of the transformer and the switching circuit and having an inductance value such that current in the inductor during dead-time of the switching circuit is sufficient to charge and discharge parasitic output capacitances of switches of the switching circuit independently of current in a magnetizing inductance of the transformer. The inductor connected in parallel with the primary winding of the transformer and a common node of switches of switches of the switching circuit thus decouples the switching circuit from inductance of the transformer such that the inductor can have an inductance sufficiently lower than a magnetizing inductance of the transformer that zero voltage switching can be achieved in the switching circuit while using a higher magnetizing inductance of the transformer to balance currents delivered to unbalanced loads.

BRIEF DESCRIPTION OF THE DRAWINGS

The foregoing and other objects, aspects and advantages will be better understood from the following detailed description of a preferred embodiment of the invention with reference to the drawings, in which.

DETAILED DESCRIPTION OF A PREFERRED EMBODIMENT OF THE INVENTION

Figure 1A:
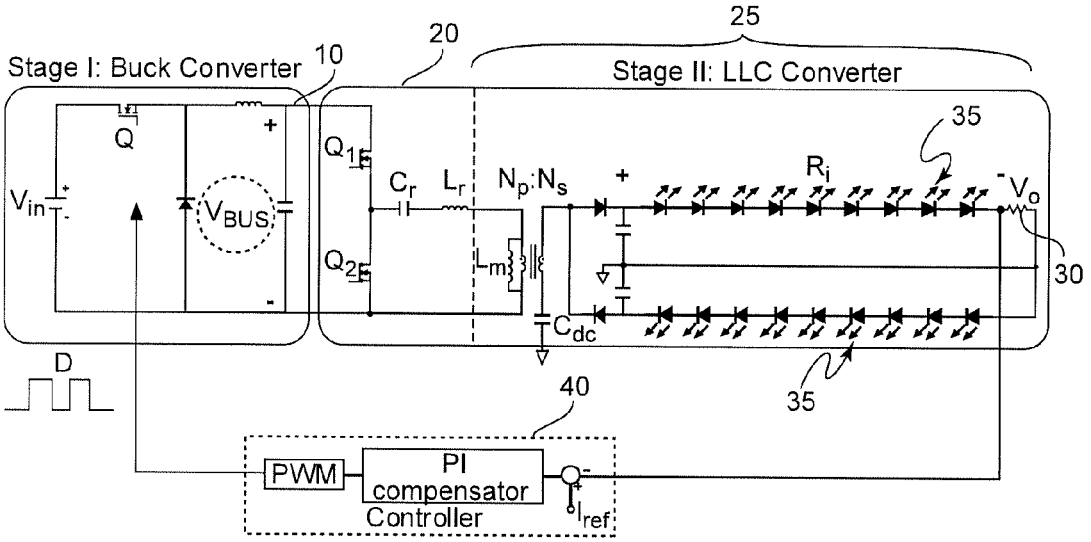
Figure 1A (Related Art)
FIG. 1A is a schematic diagram of a two-stage LLC resonant LED driver circuit over which the invention provides numerous improvements and advantages.
Figure 3:
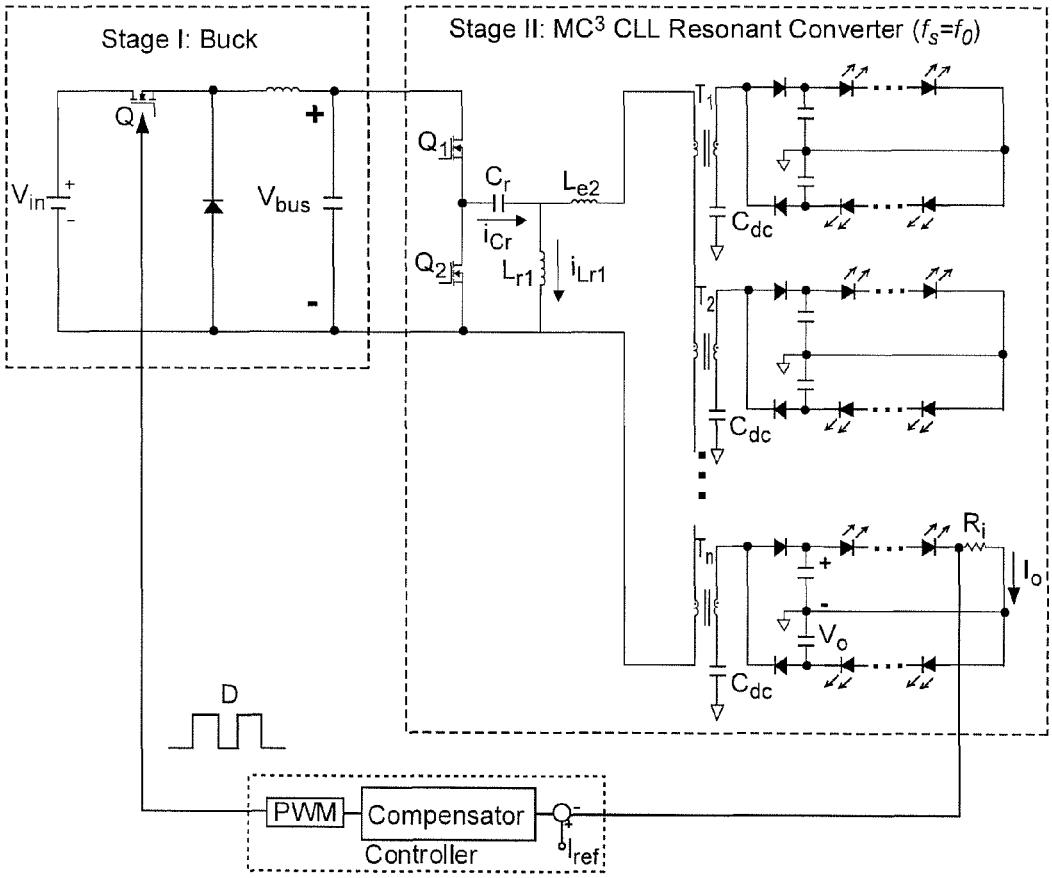
FIG. 3 is a schematic diagram of a basic CLL resonant converter in accordance with the invention.

Referring now to the drawings, and more particularly to FIG. 1A, there is shown a schematic diagram of a generalized two-stage LLC resonant LED driver circuit over which the present invention provides significant improvements and advantages. Since this diagram is generalized and arranged to facilitate comparison of the invention therewith to better convey an understanding of the invention, no portion of FIG. 1A is admitted to be prior art in regard to the present invention and FIG. 1A has, accordingly, been labeled as "Related Art". A similar circuit is schematically depicted in FIGS. 1 and 3 of U.S. patent application Ser. No. 14/140,008, filed Dec. 24, 2013, which is hereby incorporated by reference in its entirety.

Figure 5:
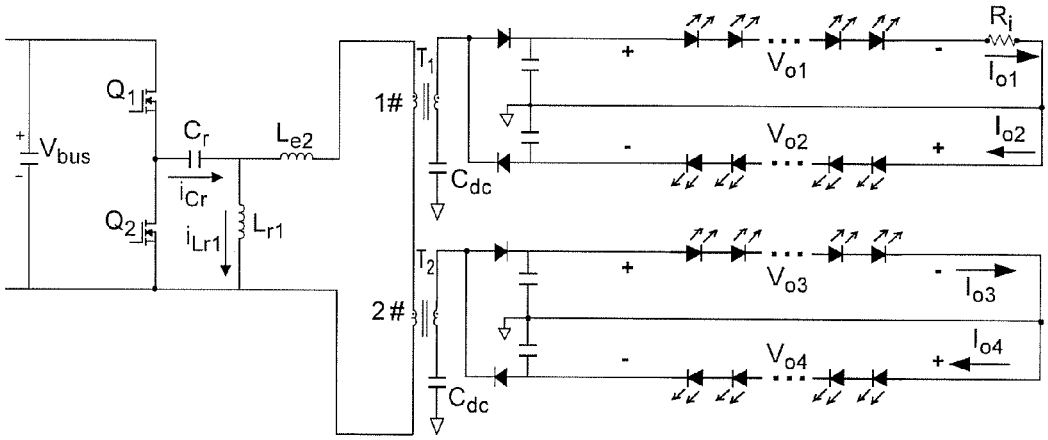
FIG. 5 is a schematic diagram of an LED driver with unbalanced loads in four LED strings.

The LED driver depicted in FIG. 1A provides a lower dimming ratio than other known LED drivers and does so with a relatively small number of components. The small number of components conveniently provides for comparatively high power density and reduced cost. This LED driver preferably comprises a buck converter 10 for simplicity and low component count, although other converter topologies can also be used as a first stage, and a multi-channel constant current ($MC^3$) LLC resonant converter 20 as a second stage which can also be implemented easily. The $MC^3$ LLC resonant converter is unregulated and functions as a DC transformer (DCX). The transformer secondary connection, rectifiers and filter capacitors function as a voltage doubler in order to drive two strings of LEDs 35. If additional LED strings are to be driven, the portion 25 of the circuit depicted to the right of and including the transformer can be replicated and inserted into the circuit with the transformer primary windings in series. Such a connection in a an LED driver circuit including the invention is depicted in FIGS. 3 and 5 which will be described in detail below. A current sensing resistor 30, Ri, is included in one of the LED strings and the voltage developed thereon fed back to a pulse width modulation (PWM) controller to compare the current with a current reference $I_{ref}$ to control the duty cycle of buck converter 10 and thus control the current in both LED strings to the same value. The DC blocking capacitor $C_{dc}$ in series with the transformer secondary winding will balance any difference in current between the two LED strings. This feedback control is referred to as cross-regulation. If additional LED strings are provided by replicating circuit portion 25 as alluded to above, currents in the LEDS strings will also be cross-regulated since the currents flowing in the series-connected primary windings will necessarily be the same. If, for example, each LED string includes nine LEDs, under full load conditions where the current is, for example 300 mA, the forward voltage on each LED string will be about 90V. If additional LED strings of nine LEDs each are provided as alluded to above, the forward voltages and currents will be the same. If the transformer turns ratio is 3:1, the reflected voltage on the (or each) primary winding will be about 30V and, assuming the input power voltage is adequate, the cross-regulation control of the buck converter 10 will supply sufficient voltage to the transformer primary winding or series connection thereof. Accordingly, the current balance capability for equal LED string numbers/lengths is excellent.

In practice, however, the length/numbers of LEDs in respective LED strings may not always be equal. For example, the lengths/numbers of LED strings may be different by design (e.g. to accommodate irregular light source shapes) and, even if initially designed and constructed to be equal, the number of LEDs in a given string may be altered by failure (e.g. opening or shorting) of one or more LEDs in a given string or even by variation in forward voltage of individual LEDs; causing the loads to become unbalanced although good current balance between LED strings remains desirable and extremely important for LEDs of different LED strings to have consistent luminous output. However, it has been discovered by the inventors that the choice of magnetizing inductance of the transformer which is critical to achieving zero voltage switching (ZVS) of the primary side switches of the second stage 20 is also critical to the degree of current balancing that can be achieved.

In an ideal transformer, the magnetizing inductance would be infinite since the reluctance of the core in an ideal transformer would be zero and the inductor cannot serve as a source of voltage as the current in the primary winding goes to zero.Therefore, even in non-ideal transformers where the core reluctance is very low, the magnetizing inductance can be neglected in the design of most circuits. Where not neglected, the magnetizing inductance is normally depicted schematically as an inductance in parallel with the transformer primary winding. However, in a switching converter, the voltage across the primary winding also appears across the switches producing alternating current to drive the transformer and, to achieve zero voltage switching (ZVS) during the dead-time of the switching cycle, the magnetizing inductance must be low and must be designed to guarantee ZVS at full load of the converter. (If ZVS is achieved for full load, it will also be achieved for light loads.) Magnetizing inductance may be reduced by, for example, increasing the length of an air gap in the transformer core and a magnetizing inductance value of 13.3 μH is chosen to guarantee ZVS in view of the chosen frequency of the LLC resonant circuit and the chosen values of Cr and Lr and the chosen dead-time duration. (Dead-time is provided by control of the switch driver circuit so that one of the series-connected switches is turned off prior to the other of the series-connected switches being turned on to avoid forming a short-circuit across the input power bus.) For ZVS, the magnetizing current of the transformer (that may be considered as an inductor current in parallel with the primary winding) primarily functions to charge and discharge the parasitic output capacitances of the switches of the primary side to assist in achieving ZVS switching during the dead-time in order to minimize switching losses and thus the magnetizing inductance is chosen to guarantee ZVS under full load conditions regardless of the number of DCX circuits employed for balanced LED strings, as will be discussed in greater detail below. However, if the loads/LED strings are unbalanced, the magnetizing inductances which are desirably equal for balanced loads/LED strings causes an aggravated difference in currents in LED strings.

Consider an LLC resonant LED driver similar to that of FIG. 1A but having two DCX sections 25 and four LED strings wherein the two LED strings driven through one of the two DCX section each having nine LEDs (and current sensing is performed in one of these two LED strings for cross-regulation) and the two LED strings driven through the other DCX section have three LEDs each. In this circumstance, the full load current in the LED strings having nine LEDs each remains 300 mA, as before, but the current in the LED strings having three LEDs each becomes 387 mA, a 29% difference. Accordingly, the forward voltage (e.g. 30V) of the LED strings having only three LEDs each is approximately one-third of the forward voltage (e.g. 90V) of the LED strings having nine LEDs each. Therefore, the corresponding reflected voltages across the primary windings of the transformers of the respective DCX sections (assuming a 3:1 turns ratio as alluded to above) becomes 30V and 10V and results in a significant difference in the magnetizing currents of the respective transformers which, in turn, causes a very large difference in the secondary side winding of the respective transformers. As a result, there will be a large difference in currents in the LED strings and, consequently, in the luminous output of the LED strings of the respective DCX sections.

Thus, it can be readily understood that the greater the imbalance between the loads/LED strings, the larger the difference in LED string current will be; reductions in load/LED numbers of a given string leading to larger currents. Similarly, the smaller the magnetizing inductance chosen (effectively shunting the primary winding of each transformer) the worse the current imbalance will be among unbalanced loads/LED strings. Conversely, increasing the magnetizing inductance (and impedance) can reduce the magnetizing current to an arbitrarily small and potentially negligible fraction of the total transformer current; reducing the LED string current imbalance and making the LED luminous output substantially uniform. For example increasing the magnetizing inductance of 13.3 pH as alluded to in the above example with nine LEDs/string for one DCX section and three LEDs/string in another DCX section, to 160 pH can reduce the current variation between LED string to less than 1% even though large differences of transformer primary winding voltage and magnetizing currents will still exist; the magnetizing currents being simply reduced to a small fraction of the resonant current in the primary windings of the transformers. Therefore excellent LED string current balancing can be achieved with such a larger magnetizing inductance (e.g. increased by somewhat more than an order of magnitude from the magnetizing inductance value guaranteeing ZVS at full load).

Thus, in summary of the behavior of a LLC resonant circuits for driving unbalanced loads/LED strings, large magnetizing inductances are favored for load/LED string current balance while small magnetizing inductances are favored to facilitate achieving ZVS since the magnetizing inductance along with the series connected resonant inductance, Lr, resonates with resonant capacitance Cr. Due to this conflict in inductance values that favor respective desirable properties on an LED driver circuit, an LLC resonant converter is not a good choice where the imbalances between loads/LED strings may be large because the beneficial ZVS property of LLC resonant converters is severely compromised or entirely lost if the magnetizing inductance of the transformer is made large to reduce load/LED string current imbalance. Loss of ZVS will significantly increase the turn-on losses of the primary side switches since the energy stored in the parasitic output capacitances of the respective primary side switches will be dissipated in the switch conduction channel when each switch is made conductive. Further, without ZVS, the current to charge the parasitic capacitance of the complementary (turned off) switch is also carried by the conduction channel of the conductive primary side switch, causing additional power dissipation and efficiency losses. Therefore the design window for obtaining satisfactory operation of LED drivers and illumination devices employing LEDs, if any, is very small and, since individual LEDs may fail unpredictably after being put in service, compromises the useful lifetime and manufacturing yield of entire LED illumination devices using LLC resonant circuits while LLC resonant circuits have remained the resonant circuit of choice prior to the present invention due to their simplicity, low component count and low cost and volume. As alluded to above, LLC resonant converters have also been chosen since they can provide a greater degree of dimming of LED strings for applications where a high degree of control of luminous output is desired.

The inventors have, however, discovered that a small change in resonant circuit topology including only a single additional electronic component can provide a solution to the previously intractable conflict between desired resonant circuit properties for LED drivers for illumination devices. The resonant circuit in accordance with the invention is referred to as a CLL resonant circuit; a basic form of which is schematically illustrated in FIG. 12. From a comparison of FIGS. 1A and 12 it can be readily appreciated that the CLL resonant circuit differs from an LLC resonant circuit simply by the addition of a single, generally small valued inductor in parallel with the series connection of the transformer and an external resonant inductor and in parallel with the series-connected primary side switches. To facilitate an appreciation of the invention which maintains all of the advantages of use of an LLC resonant circuit while solving a design conflict and engendering additional useful and desirable properties when applied in an LED driver, LLC and CLL resonant circuits in power converters will now be compared.

Figure 4A:
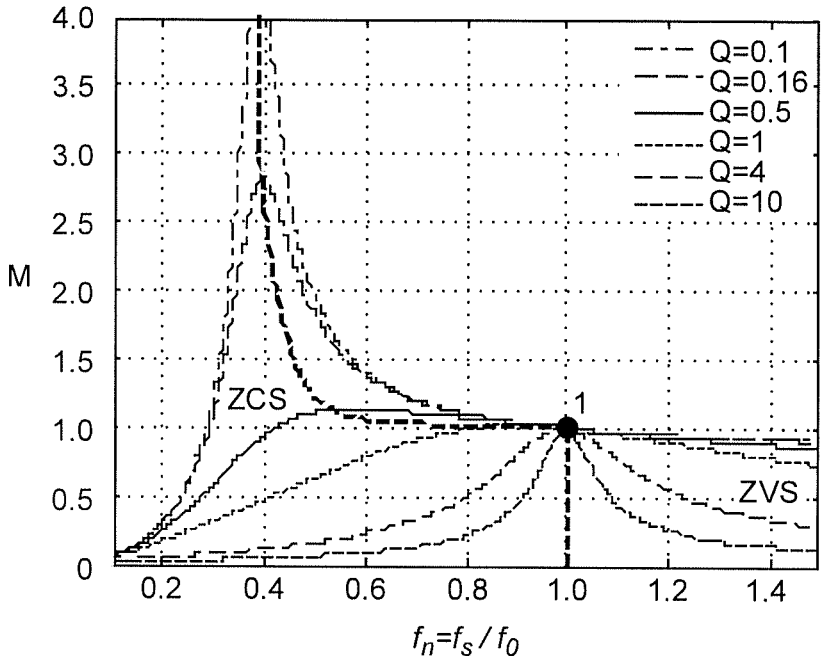
Figure 4A (Related Art)
FIGS. 4A and 4B are graphs of voltage gain of LLC and CLL resonant converters of FIGS. 1A and 1B, respectively.

In an LLC power converter as illustrated in FIG. 1A, $C_r$ and $L_r$ are in series and constitute the resonant tank circuit. Under normal operating conditions $C_r$ and $L_r$ resonate with each other. After the secondary side current, $i_s$, reaches zero, the magnetizing inductance, $L_m$, will also augment the resonant inductance (since, at this moment, $L_r$ and the magnetizing$_{inductance,\ Lm}$, are in series and the resonant inductance is $L_r$+$L_m$) to resonate with $C_r$. This is the basic operation principle of LLC resonant converters. The voltage gain of an LLC resonant converter is graphically illustrated in FIG. 4A which indicates two operational zones for zero current switching (ZCS) and ZVS of the LLC which, as illustrated, are separated by a dashed line between the series resonant frequency range and the parallel resonant frequency range. In an LLC resonant converter, operation at a series resonant frequency would be inherent if ZVS is to be achieved as discussed above. Since the magnetizing inductance is in series with $L_r$ And $C_r$ and necessarily resonates therewith, the magnetizing inductance is critical for ZVS to be achieved and the reason that ZVS is substantially precluded in an LLC resonant converter if the magnetizing inductance is increased to limit load/LED string current imbalance to acceptable levels. The voltage gain at the series resonant frequency is one.

Figure 1B:
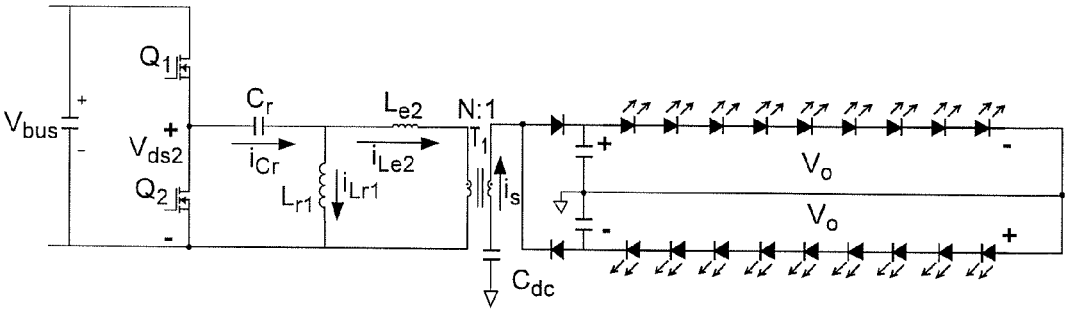
FIG. 1B is a schematic diagram of a two-stage LED driver circuit in accordance with the invention.
Figure 4B:
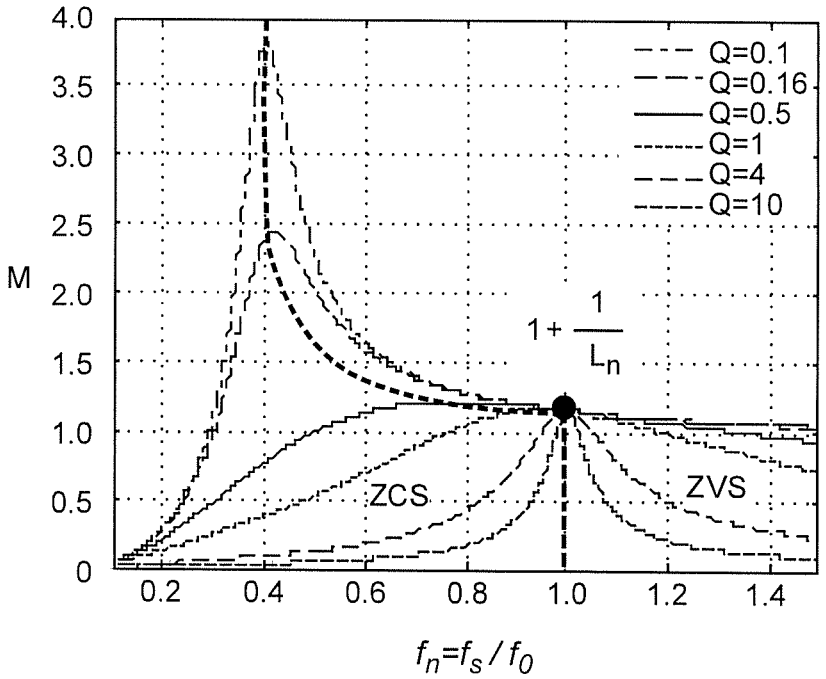

In contrast, in the CLL resonant converter of FIG. 1B, $C_r$ is in series and resonates with the parallel connection of $L_{r1}$ and the external inductor, $L_{e2}$ during normal operation. However, after the secondary side current, $i_s$ reaches zero, $C_r$ resonates only with $L_{r1}$. This is the basic operating principle of a CLL resonant converter. The voltage gain of the CLL resonant converter is graphically illustrated in FIG. 4B. The voltage gain of the CLL converter at the series resonant point is $1+1/L_n$ where $L_n=L_{r1}/L_{e2}$ which is greater than the voltage gain of the LLC resonant converter. Such increased gain may be useful in boost applications but is otherwise unimportant to the invention since LED drivers may also be designed with an output voltage that is less than the input voltage.

In contrast with the LLC resonant converter where the magnetizing current provided charging and discharging of the parasitic capacitances of the primary side switches, in the CLL resonant converter, the current flowing in $L_{r1}$ provides charging and discharging of the parasitic capacitances of the primary side switches; thus decoupling the achievement of ZVS from the value of the magnetizing inductance which can thus be made as large as desired to achieve substantially complete load/LED string current balancing even where the imbalance between numbers of LEDs in respective LED strings is large. Indeed, the magnetizing inductance in CLL resonant converters is not at all critical and can be ignored in some, if not most, circumstances for simplification of the design of $L_{r1}$ and choice of its inductance value as will be discussed in some detail below as is set out analytically in the above-incorporated U.S. Provisional Patent Application. Otherwise, the desired properties of LLC resonant circuits in power converters are maintained in CLL resonant circuits. While the value of $L_{r1}$ is important in achieving ZVS in a CLL resonant converter, ZVS during dead time can be achieved relatively easily by adjusting the value of $L_{r1}$.

As alluded to above, the architecture, topology and operation of the CLL resonant converter and LED driver in accordance with the invention are very similar to those of LLC resonant converters which are well-known and understood in the art. However, in the interest of completeness of the description of the invention, these aspects of the CLL resonant converter will now be discussed.

The structure of two-stage CLL resonant LED driver in accordance with the invention is very simple. A buck converter is preferred as the first stage and a $MC^3$ CLL resonant converter is provided as the second stage, as depicted in FIG. 1B. For the second stage, there is only one CLL resonant tank circuit regardless of the number of DC transformer (DCX) modules/circuits that are included to drive the desired number of LED strings. Multiple transformer modules can be connected in series at the primary side as illustrated in FIG. 3. A voltage doubler structure is adopted at the secondary side of the transformer in each DCX module. Thus, each transformer module concurrently drives two LED strings. The currents of those two LED strings driven by the same transformer are balanced via the DC blocking capacitor, $C_{dc}$, which is in series with the secondary side winding of the transformer. Since the current flowing through the primary side windings of all transformers is the same by virtue of the series connection thereof, the currents flowing through the secondary side windings of transformers are almost the same as well if the length of the LED strings is equal/balanced. Some variation in secondary current may, however, be caused by forward voltage and impedance variation in individual LEDs but will tend to average to approximately the same if relatively longer LED strings are provided. If more LED strings are needed, it can be realized by simply plugging more transformer modules at the primary side and making them in series at the primary side. Additionally, the $MC^3$ CLL resonant converter is unregulated and it is always operating at a frequency close to the CLL resonant frequency to achieve best efficiency.

The current of one specific LED string (that can be arbitrarily selected) is sensed for feedback control to tune the duty cycle of the buck converter as shown in FIG. 3 and will provide cross-regulation of additional DCX modules as discussed above. Therefore, $V_{bus}$ which is the input voltage of $MC^3$ CLL as well, is adjusted according to the output demand (variation of the number of LED strings and number of LEDS in the respective LED strings and/or controlled dimming as desired). If the number of LED strings or the number of LEDs per string changes (e.g. to accommodate various design or control requirements by switching one or more DCX modules out of the circuit or by selective control of numbers of LEDs in one or more LED strings, or upon failure of one or more individual LEDs), $V_{bus}$ will automatically be adjusted accordingly. $V_{bus}$ can be freely tuned to satisfy any desired dimming of luminous output, as well, and low dimming can be achieved easily with this structure by adjustment of $I_{ref}$ in the same manner and degree as in an LLC resonant converter. Hence, this two-stage LED driver is very suitable for multiple LED strings application. Further, this structure is able to adapt to the variation of the number of LED strings and number of LEDs in each LED string.

Figure 2A:
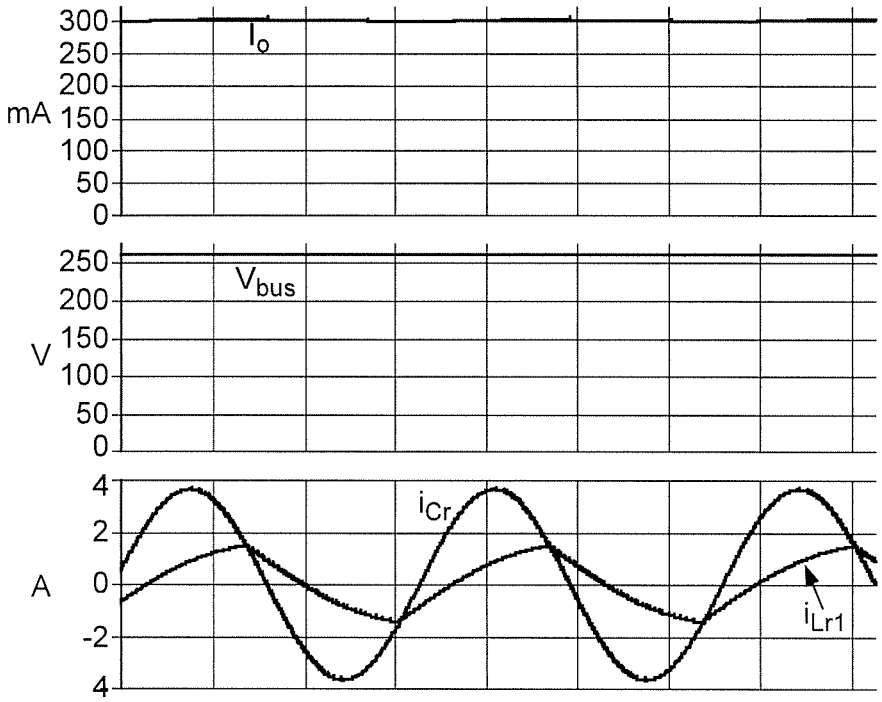
FIGS. 2A, 2B and 2C are waveforms of the LED driver of FIG. 1 for different dimming levels.
Figure 2B:
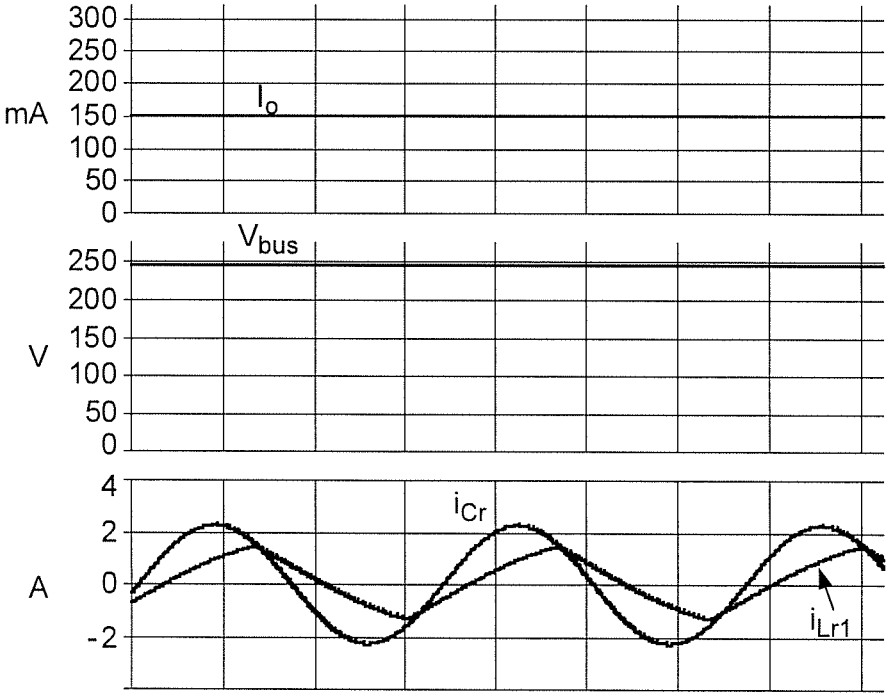
Figure 2C:
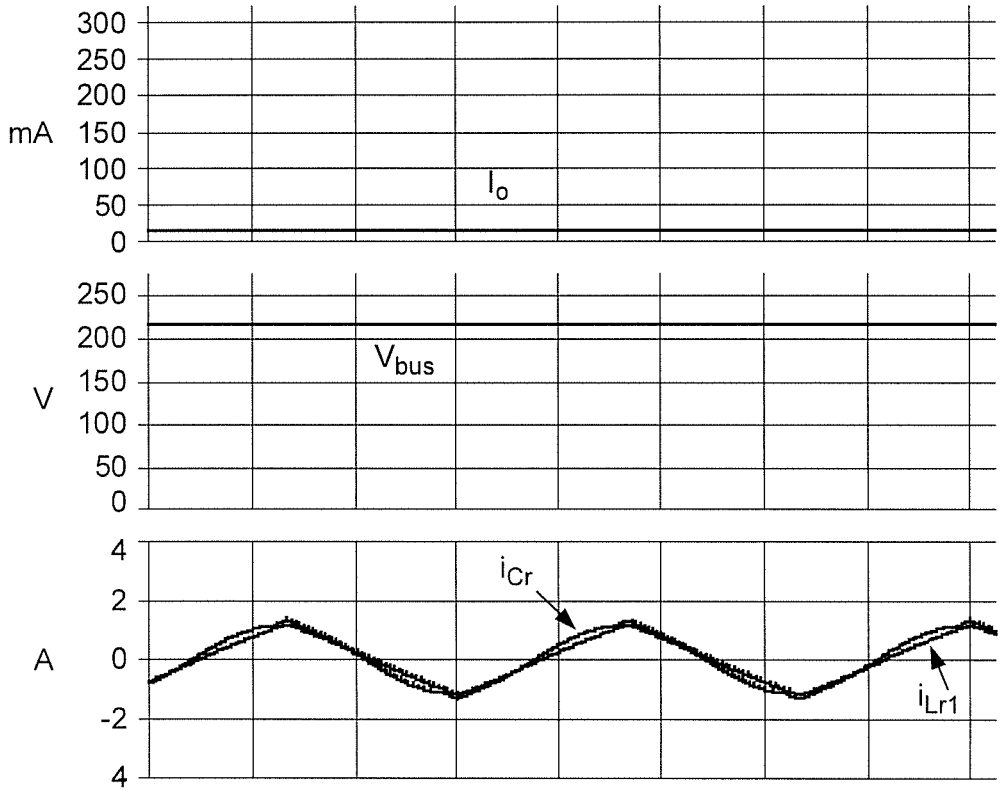

For example, as generally depicted in FIG. 3, if there are five transformer modules and ten LED strings, the two LED strings driven by the same transformer module both have 28 LEDs and the loads are balanced. When LEDs are working at full load, 50% dimming and 5% dimming condition, the simulation waveforms of this two-stage LED driver are shown in FIGS. 2A-2C. It is important to observe that $V_{bus}$ varies in accordance with changes in Io. Therefore $V_{bus}$ can be varied to control Io and LED string luminous output. It is also important to observe that, even when Io varies, $I_{Cr}$ remains sinusoidal which means that the switching frequency of the $MC^3$ CLL resonant converter is always near the resonant frequency even though Io may vary. These observations are important because the conventional LLC resonant converter will use frequency control to control Io and thus will operate at differing frequencies with different Io with consequent efficiency losses which are avoided by the CLL resonant converter of the invention. It can also be observed by comparing these waveforms that $I_{Cr}$ varies proportionally with Io while $I_{lr}$ remains constant and that the difference between $I_{Cr}$ and $I_{lr}$ is the current delivered to the diode strings. $V_{bus}$ is tuned according to the dimming requirement and $MC^3$ CLL resonant converter is always running at or near the resonant frequency. The resonant frequency of the CLL circuit can be obtained as:

$$f_0 = \frac{1}{2\pi\sqrt{C_r L_{eq}}} \quad (1)$$

$$\text{where } L_{eq} = \frac{L_{r1} L_{e2}}{L_{r1} + L_{e2}}.$$

As alluded to above, the CLL resonant converter may be regarded as a variant of LLC resonant converter but provides some additional functionality properties and, importantly, operational differences. The CLL resonant tank circuit comprises $C_r$, $L_{r1}$, and $L_{e2}$. In normal operation, $C_r$ will resonate with $L_{r1}$, and $L_{e2}$. There are three elements in resonance and the resonant frequency, referred to as the series resonant frequency, can be obtained from equation (1) above. After $i_s$ reaches zero, $C_r$ will start to resonate with $L_{r1}$, if the load is not excessive. At that moment, there are only two elements in resonance and this resonant frequency is referred to as the parallel resonant frequency which can be obtained from equation (2) as:

$$f_{02} = \frac{1}{2\pi\sqrt{C_r L_{r1}}} \quad (2)$$

Thus, the operation of the CLL circuit differs somewhat from LLC operation. For the LLC circuit, there are two elements in resonance in normal operation and there are three elements involved in resonance after the current flowing through secondary side winding reaches zero. As alluded to above, in the CLL circuit there are three elements in resonance in normal operation and two elements in resonance after the current in the secondary side reaches zero.

The voltage gain of CLL is presented FIG. 42. Its characteristic is very similar to that of the LLC. There are two operation zones for the primary side main switches $Q_1$ and $Q_2$. One is the ZCS zone, and the other is ZVS zone. As depicted, these two zones are divided by a dashed line. However, the voltage gain of CLL at the resonant frequency point is greater than 1, which is much useful for voltage step-up applications. This is another feature that distinguishes CLL from LLC.

The main characteristics of a CLL resonant circuit are expressed in equations (3)-(7).

Voltage gain $$M=2V_o \cdot N/V_{bus}. \quad (3)$$

Resonant inductor ratio $$L_n=L_{r1}/L_{e2}. \quad (4)$$

Characteristic impedance $$Z_0=\sqrt{L_{eq}/C_r}. \quad (5)$$

Quality factor $$Q=Z_0/(N^2 \cdot R^L). \quad (6)$$

Voltage gain at resonant frequency $$M_{f_s=f_0}=1+1/L_n \quad (7)$$

where $R_L$ is the equivalent resistance of the two parallel LED strings.

Importantly, for the CLL resonant converter, the magnetizing inductance of the transformer can be as large as may be desired for good current balancing/sharing since the magnetizing current does not play an important role in achieving ZVS during dead time. In contrast to the LLC resonant converter, the current flowing through the external inductance $L_{r1}$ is used for charging and discharging the output capacitors of $Q_1$ and $Q_2$, respectively, rather than the magnetizing current which must be reduced to low levels for good current balancing. This is another important difference between CLL and LLC resonant converters since the CLL resonant converter decouples current balancing from conditions necessary to achieve ZVS.

For simplicity, the impact of small magnetizing current can be ignored in practice, so $i_{cr} \approx i_{Lr1}$ during the dead time. Therefore, $L_{r1}$ can easily be designed properly to meet the ZVS requirements for $Q_1$ and $Q_2$ within essentially a single broad constraint on a maximum value of inductance. Moreover, For a given value of $L_{r1}$, ZVS can be more easily achieved for larger numbers of DCX circuits and LED strings since higher numbers of DCX circuits cause $V_{bus}$ to be regulated at higher voltages.

Specifically, for ZVS, it is only necessary that the voltage across the parasitic output capacitor of one of the complementary switches to reach zero volts prior to the other complementary switch becoming conductive. Thus, the limit on the inductance value for $L_{r1}$ can be calculated in a manner similar to the following examples.

As the $MC^3$ CLL resonant converter is running at resonant frequency, the current flowing through external inductor $L_{r1}$ plays an important role in charging the output capacitor of one switch and discharging the output capacitor of the other switch during dead time. Since the magnetizing inductance of the transformer is very large, the impact of the magnetizing current during dead time is ignored. ZVS is attained if the voltage cross the output capacitor reaches zero before the corresponding switch turns on. ZVS is preferred for CLL to achieve higher efficiency. The current $i_{Lr1}$ keeps constant during dead time interval, so the inductor $L_{r1}$ can be considered as a current source during the dead time.

If the number of transformer modules plugged into the circuit varies from 1 to 5, the bus voltage will vary from 60V to 300V under the full load conditions. Since the parasitic output capacitor of a power MOSFET is a nonlinear capacitor and depends on $V_{ds}$, the ZVS conditions for 1 transformer and 5 transformers are different.

In the case of one transformer module, if there are Two LED strings, only one transformer is needed. If each string has 9 OLEDs, under the full load condition (Io=300 mA), Vo=90V. The bus voltage under this condition is $V_{bus} \approx 2NVo = 2 \times \frac{1}{3} \times 90 = 60V$.

The peak value of $i_{Lr1}$ can be obtained from the equation:

$$I_p = \frac{V_{bus}}{2} \cdot \frac{T_o}{4} \cdot \frac{1}{L_p} \quad (8)$$

-continued $$\text{where } L_p = \frac{L_{r1}^2}{L_{r1} + L_{e2}}. \tag{9}$$

In order to achieve ZVS for the primary side switches, the current $I_p$ should meet the following inequality:

$$I_p t_d \geq 2\int_0^{V_{bus}} C_{oss}(v_{ds}) dv_{ds} \tag{10}$$

Substituting $I_p$ in this inequality (10) with Equation (8), yields $$L_p \leq \frac{V_{bus} \cdot T_o \cdot t_d}{16\int_0^{V_{bus}} C_{oss}(v_{ds}) dv_{ds}} \tag{11}$$

The maximal $L_{p_max}$ for one transformer module to realize ZVS at a given dead time $t_d$ is $$L_{p_max} = \frac{V_{bus} \cdot T_o \cdot t_d}{16\int_0^{V_{bus}} C_{oss}(v_{ds}) dv_{ds}|_{V_{bus}=60}} \tag{12}$$

Substitute $$\int_0^{V_{bus}} C_{oss}(v_{ds}) dv_{ds}$$

with $$V_{bus} \cdot C_{oss_tr}(V_{bus})$$

yields $$L_p \leq \frac{V_{bus} \cdot T_o \cdot t_d}{16V_{bus} \cdot C_{oss_tr}(V_{bus})} = \frac{T_o \cdot t_d}{16C_{oss_tr}(V_{bus})} \tag{13}$$

namely, the maximal $L_p$ for the case with one transformer module is $$L_{p_max} = \frac{T_o \cdot t_d}{16C_{oss_tr}(V_{bus})|_{V_{bus}=60}} \tag{14}$$

For the case of five transformer modules, there are ten LED strings. If there are 9 LEDs for each LED string, under the full load condition ($I_o$=300 mA), $V_o$=90V. The bus voltage under this condition is $$V_{bus} \approx 2 \cdot 5NV_o = 2 \times 5 \times \frac{1}{3} \times 90 = 300 \text{ V} \tag{15}$$

The peak value of $i_{Lr1}$ can be obtained from the following equation:

$$I_P = \frac{V_{bus}}{2} \cdot \frac{T_o}{2} \cdot \frac{1}{L_p} \tag{16}$$

where $$L_p = \frac{L_{r1}^2}{L_{r1} + L_{e2}} \tag{17}$$

Compare Equation (16) with Equation (8), the bus voltage with five transformer modules is five times larger than the bus voltage with one transformer module. In order to achieve ZVS for the primary side switches, $I_p$ should meet the following inequality:

$$I_p t_d \geq 2\int_0^{V_{bus}} C_{oss}(v_{ds}) dv_{ds} \tag{18}$$

Substitute $I_p$ in Inequality (18) with Equation (16), yields:

$$L_p \leq \frac{V_{bus} \cdot T_o \cdot t_d}{16\int_0^{V_{bus}} C_{oss}(v_{ds}) dv_{ds}} \tag{19}$$

In the five transformer modules case, the maximal $L_p$ to realize ZVS at a given dead time $t_d$ is $$L_{p_max} = \frac{V_{bus} \cdot T_o \cdot t_d}{16\int_0^{V_{bus}} C_{oss}(v_{ds}) dv_{ds}|_{V_{bus}=300}} \tag{20}$$

Substitute $$\int_0^{V_{bus}} C_{oss}(v_{ds}) dv_{ds}$$

with $$V_{bus} \cdot C_{oss_tr}(V_{bus})$$

yields $$L_p \leq \frac{V_{bus} \cdot T_o \cdot t_d}{16V_{bus} \cdot C_{oss_tr}(V_{bus})} = \frac{T_o \cdot t_d}{16C_{oss_tr}(V_{bus})} \tag{21}$$

namely, the maximal $L_p$ for the five transformer modules case is $$L_{p_max} = \frac{T_o \cdot t_d}{16C_{oss_tr}(V_{bus})|_{V_{bus}=300}} \tag{22}$$

Since $$C_{oss_tr}(V_{bus})|V_{bus}=300$$

is less than $$C_{oss_tr}(V_{bus})|V_{bus}=60,$$

the higher $V_{bus}$ is, the easier the switches can achieve ZVS for a given $L_p$. In other words, if the parameters of the resonant tank are the same, ZVS of primary side switches with five transformer modules is easier to achieve than the case with one transformer module. It follows that a value of $L_{r1}$ that is sufficient to achieve ZVS within the switching dead time in the case of one transformer module will be sufficient to achieve ZVS for any larger number of transformer modules if a sufficient input $V_{bus}$ voltage is provided. Further, since it is only necessary to provide an inductance value that is less than $L_{r1_max}$, a commercially available inductor may be used or designed and fabricated in view of reluctance of available inductor cores and the chosen dead time duration for the required RMS values of primary and secondary transformer currents which will be evident to those skilled in the art and, in any case, are set out in detail in the above-incorporated provisional patent application.

In view of the foregoing, it is clearly seen that the invention provides a good candidate for LED driving. It should be appreciated that the decoupling of good current sharing when LED strings are unbalanced from achievement of ZVS through the provision of an additional inductance in parallel with the magnetizing inductance of a transformer and that many resonant circuit topologies other than a CLL topology can include such an element. However, a CLL topology is much preferred for its simplicity and similarity to well-known LLC resonant circuits. For the $MC^3$ CLL resonant converter as FIG. 1 shows, the magnetizing inductances of the transformers could be very large, so the magnetizing currents have little influence on the currents flowing through the secondary side windings of transformers. Therefore, excellent current sharing among transformer modules can be achieved. For those two LED strings driven by the same transformer, their currents will be balanced via the DC block capacitor $C_{dc}$ which is in series with the secondary side winding of transformer. Therefore, any voltage difference between those two LED strings will be balanced with the DC bias voltage across $C_{dc}$.

For example, two transformer modules and 4 LED strings are shown in FIG. 5. The two strings driven by 1# transformer have 28 LEDs per string, and the other two strings driven by 2# transformer only have 10 LEDs per string. The loads are thus severely unbalanced in a ratio of nearly 3:1, similar to the example of a LLC resonant converter discussed above. In this case, the current of the LED string which is used for feedback is set to be 300 mA, selected as a full load current. The forward voltage and average forward current of each respective string are given in Table I.

TABLE I

| String # | # LEDs | Vo (V) | io (mA) |
|---|---|---|---|
| 1 | 28 | 90.1 | 300 |
| 2 | 28 | 90.1 | 300 |
| 3 | 10 | 30.0 | 302.1 |
| 4 | 10 | 30.0 | 302.1 |

Figure 6:
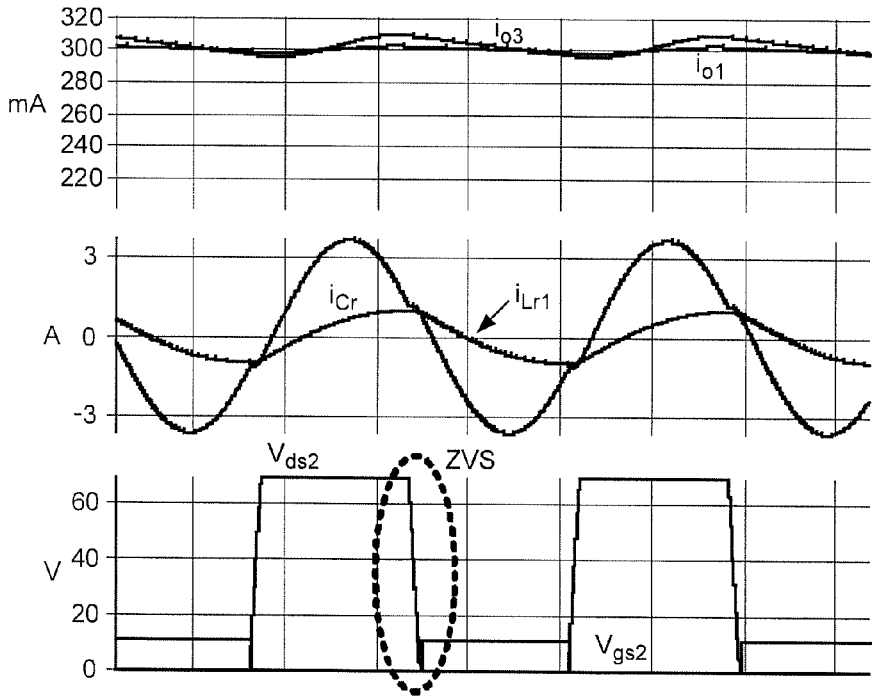
FIG. 6 is a graphical representation of waveforms due to the unbalanced loads in the LED driver of FIG. 5.

Although the forward voltages are different, the average forward currents are almost the same (only with 0.7% deviation). The simulation waveforms for this $MC^3$ CLL resonant converter are also presented in FIG. 6. The current flowing through $L_{r1}$ is used to charge and discharge the output capacitor of $Q_1$ and $Q_2$ during dead time. Although the magnetizing inductance of the transformer is large, ZVS of $Q_1$ and $Q_2$ is achieved with a properly designed $L_{r1}$ as discussed above.

Figure 7:
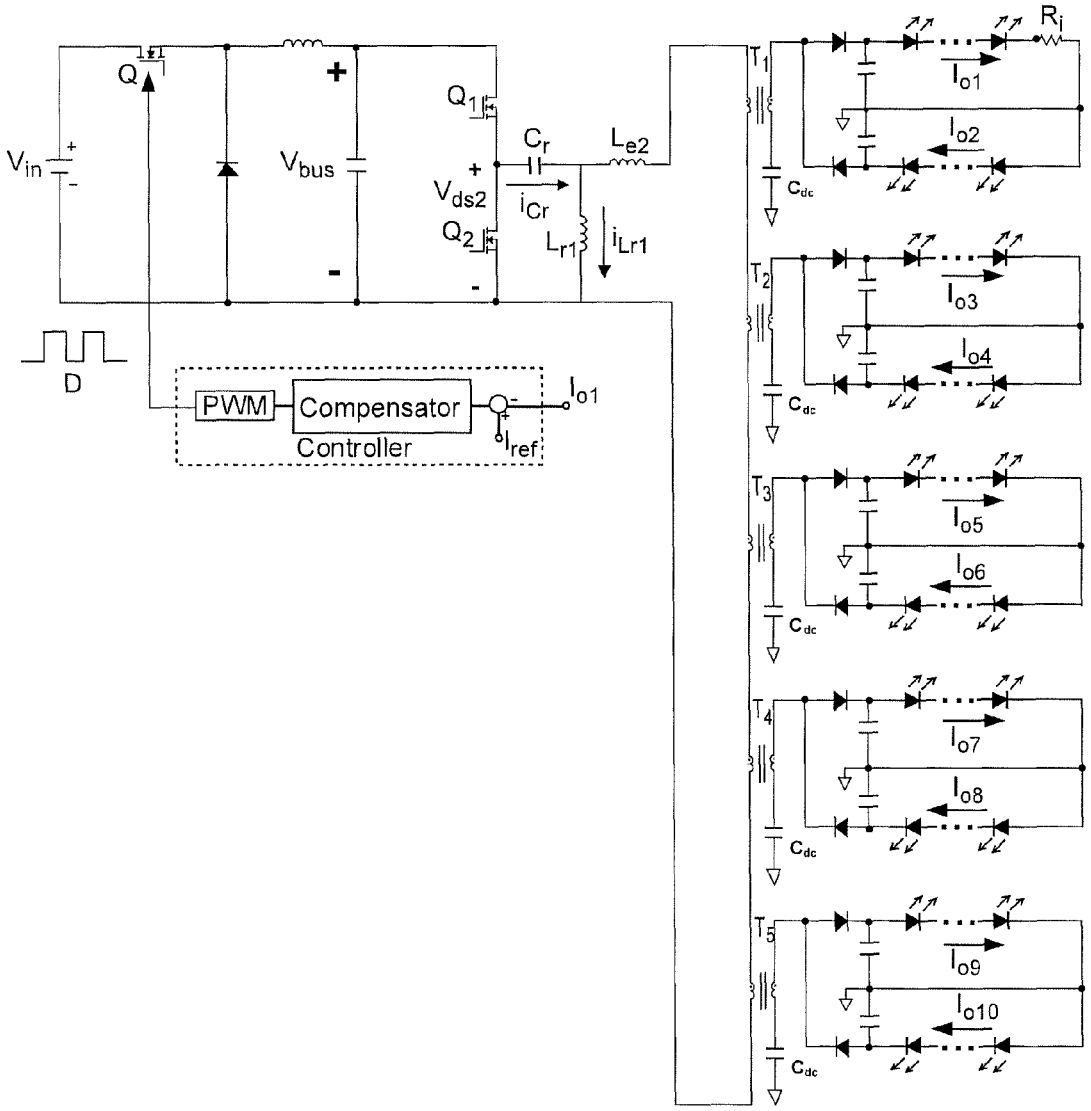
FIG. 7 is a schematic diagram of an LED driver including ten LED strings.

In order to demonstrate and verify the efficacy of the invention to achieve both primary side switch ZVS and excellent LED drive current uniformity when unbalanced LED strings are driven, a prototype of the LED driver has been built with a buck converter switching frequency of 100 kHz and an $MC^3$ CLL resonant converter frequency and switching frequency of $Q_1$ and $Q_2$ of 300 kHz and five DCX modules having either the same or different numbers of LEDs in respective LED strings. The current of string 1 is sensed to regulate the bus voltage and provide cross-regulation for all strings. A value of 80.6 μH was chosen for inductor $L_{r1}$ in accordance with the above design for guaranteeing ZVS. A generalized schematic diagram is illustrated in FIG. 7.

In a case where all LED strings have twenty-eight discrete LEDs the loads would ideally be balanced but some variation is observed due to differences in impedance of individual LEDs as shown in the output characteristics presented in Table II for the current in string 1 set to 303 mA.

TABLE II

| String # | # of LEDs | Vo (V) | Io (mA) |
|---|---|---|---|
| 1 | 28 | 89.46 | 303 |
| 2 | 28 | 90.29 | 303 |
| 3 | 28 | 91.63 | 301 |
| 4 | 28 | 91.53 | 301 |
| 5 | 28 | 90.15 | 300 |
| 6 | 28 | 91.54 | 300 |
| 7 | 28 | 90.67 | 299 |
| 8 | 28 | 90.14 | 299 |
| 9 | 28 | 90.64 | 298 |
| 10 | 28 | 91.09 | 298 |

Even with variation in voltages across individual LED strings vary the current variation among the ten LED strings is held to about 5 mA or about 2% for nominally balanced loads.

To verify performance when the loads are unbalanced in an otherwise identical driver circuit, there are also 5 transformer modules, and the two LED strings driven by the same respective transformer module are arranged have 10, 16, 19, 22 and 28 LEDs per string, respectively. The current of one LED string with 28 LEDs is sensed for feedback control and the current of this LED string is set to be 303 mA (full load condition), as before but string 1 now has only 10 LEDs. The output characteristics of these 10 LED strings with different LED numbers in respective LED strings are presented in Table III.

TABLE III

| String # | # of LEDs | Vo (V) | Io (mA) |
|---|---|---|---|
| 1 | 10 | 32.31 | 303 |
| 2 | 10 | 32.40 | 303 |
| 3 | 16 | 52.55 | 299 |
| 4 | 16 | 52.65 | 300 |
| 5 | 19 | 62.01 | 298 |
| 6 | 19 | 62.18 | 298 |
| 7 | 22 | 71.34 | 296 |
| 8 | 22 | 71.81 | 296 |
| 9 | 28 | 90.73 | 295 |
| 10 | 28 | 91.10 | 295 |

Figure 8:
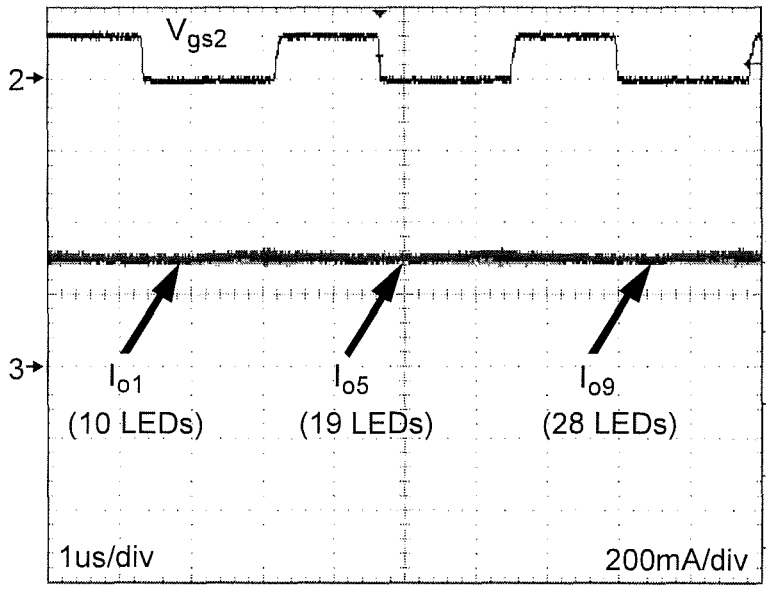
FIG. 8 is a graphical depiction of LED currents of three LED strings having different numbers of LEDS per string and thus presenting unbalanced loads.
Figure 9:
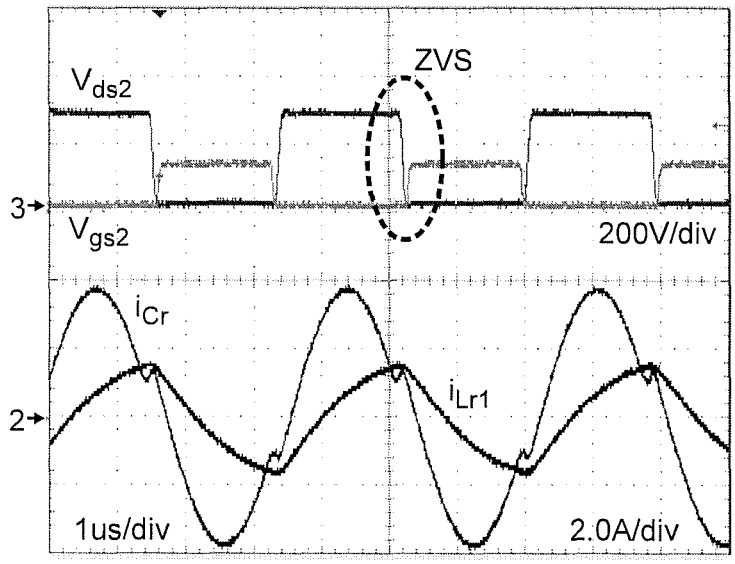
FIG. 9 is a graphical depiction of primary side LED driver waveforms showing achievement of zero voltage switching (ZVS)

Although the loads are severely unbalanced, the current variation among these 10 strings is only about 8 mA which is less than 3%. Essentially, the greater the number of LEDs in a given string, the lower the output current, Io, that will be delivered and the higher the forward voltage, Vo, of the series-connected diodes will be. The increased Vo will be reflected to the primary side of the transformer and will cause increased magnetizing current. Since the transformer primary windings are in series, the currents in the primary windings will be the same; resulting in transformers having higher magnetizing current having reduced secondary side current delivered to the LEDs. The waveforms of output currents for LED strings with 10 LEDs, 19 LEDs and 28 LEDs are presented in FIG. 8 and are seen to be extremely similar. Thus good current balancing capability is achieved even under severely unbalanced load conditions. Also, as shown in FIG. 9 where $V_{ds2}$ is discharged to zero prior to the leading edge of the $V_{gs2}$ (turn-on) pulse, ZVS of $Q_1$ and $Q_2$ is achieved by the $MC^3$ CLL resonant converter and thus avoids the switching losses alluded to above.

Figure 10:
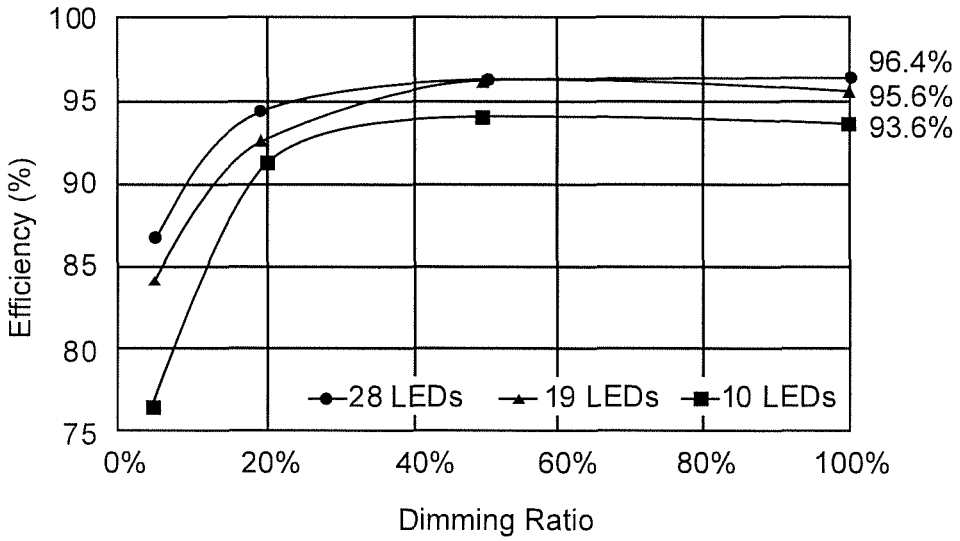
FIGS. 10 and 11 are graphs of second stage and total LED driver efficiency, respectively, for differing degrees of LED dimming.

The efficiency of the second stage was tested for the same LED driver arrangement with five DCX modules with different LED string lengths at different dimming ratios. The switching frequency of the first stage (buck) converter was 100 KHz and the switching frequency of the resonant second stage was 300 KHz. The results are illustrated in FIG. 10 which shows that high and substantially uniform efficiency is maintained above 90% for an equally wide range of LED string lengths and a dimming ratio above 20%. Loss of efficiency for greater dimming is not particularly significant since the $V_{bus}$ voltage will be regulated at a level much reduced from full load and the string currents will be low.

Figure 11:
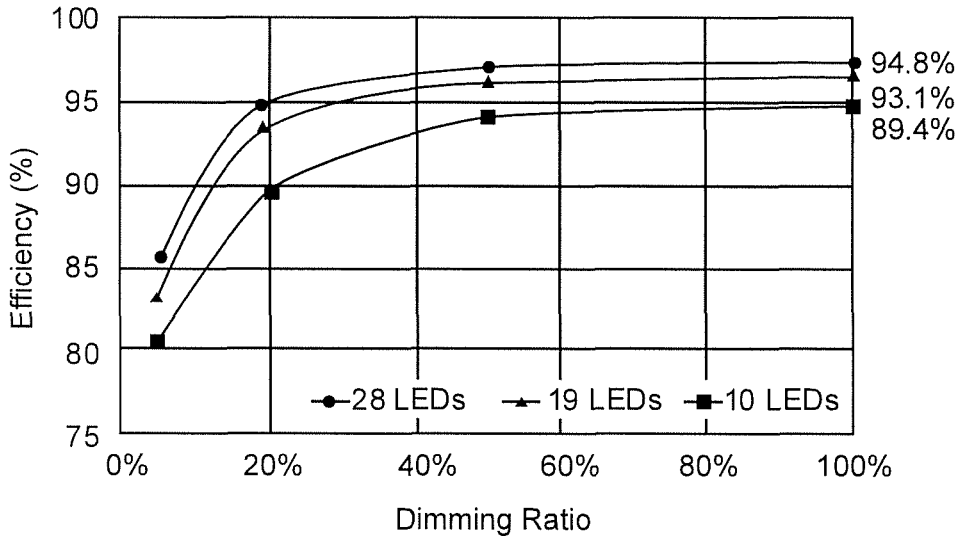

At the same first and second stage switching frequencies, similar results are obtained for the total efficiency (e.g. including losses in the buck converter stage) of the two-stage $MC^3$ CLL resonant converter in accordance with the invention as illustrated in FIG. 11. Again, high and substantially uniform efficiency is maintained over the large range of LED string length for dimming ratios above 20%.

Accordingly, it is seen that the invention provides for decoupling of achievement of ZVS for high efficiency and an arbitrarily high degree of LED drive current and illumination uniformity such that both desirable properties for an LED driver can be easily and concurrently attained with a very simple circuit having a small number of components through a resonant circuit topology which provides an inductor in parallel with both a switching circuit and a transformer primary winding, preferably embodied in a CLL resonant circuit. Therefore, the $MC^3$ CLL resonant converter in accordance with the invention is very suitable for multiple LED strings driving, even if the loads are severely unbalanced.

While the invention has been described in terms of a single preferred embodiment, those skilled in the art will recognize that the invention can be practiced with modification within the spirit and scope of the appended claims.

We claim:

1. A power converter including a first stage for regulating output voltage of said power converter from an input voltage in accordance with a sensed current, and an unregulated second stage having a switching circuit operating at a constant frequency for providing and interrupting said output voltage of said first stage to a primary winding of one or more transformers connected in series, one or more rectifier circuits to provide an output from a secondary winding of each of said one or more transformers to at least two loads, and a single resonant circuit including said one or more transformers, an external inductor connected in series with a primary winding of said one or more transformers connected in series and a capacitor, said transformer having a magnetizing inductance sufficient to substantially balance currents to said at least two loads wherein said resonant circuit further includes a further inductor having terminals connected in parallel with said external inductor and said primary winding of said transformer wherein said resonant circuit is connected in parallel with said switching circuit, said further inductor having a value that is lower than a value of said magnetizing inductance of said transformer and provides zero voltage switching in said switching circuit such that the inductance value to provide zero voltage switching is decoupled from the magnetizing inductance value that provides substantial balancing of currents to said at least two loads.

2. The power converter as recited in claim 1, wherein said rectifier circuit functions as a voltage doubler circuit to supply power to at least two loads.

3. The power converter as recited in claim 2, further including a circuit to balance currents from said transformer secondary winding to said at least two loads.

4. The power converter as recited in claim 3, wherein said circuit to balance currents comprises a connection of said secondary winding of said transformer to a reference voltage through a series-connected capacitor.

5. The power converter as recited in claim 1, wherein said rectifier circuit includes a filter capacitor.

6. The power converter as recited in claim 1, wherein said resonant circuit is a CLL circuit.

7. The power converter as recited in claim 1, wherein said transformer and said rectifier circuit comprise a transformer module.

8. The power converter as recited in claim 7, wherein said power converter includes more than one said transformer module, and wherein primary windings of transformers of said more than one transformer modules are connected in series to an output of said resonant circuit.

9. The power converter as recited in claim 7, wherein said transformer module further includes a load including a plurality of series-connected light emitting diodes.

10. The power converter as recited in claim 1, wherein said second stage includes a current sensor for controlling an output voltage of said first stage.

* * * * *